United States Patent [19]

Iderosa

[11] Patent Number: 5,038,472

[45] Date of Patent: Aug. 13, 1991

[54] PIVOTING SAFETY RAZOR ASSEMBLY

[75] Inventor: Richard A. Iderosa, West Haven, Conn.

[73] Assignee: Warner-Lambert Company, Morris Plains, N.J.

[21] Appl. No.: 438,824

[22] Filed: Nov. 17, 1989

[51] Int. Cl.[5] ..... B26B 21/00

[52] U.S. Cl. ..... 30/87; 30/51; 30/52

[58] Field of Search ..... 30/87, 57, 89, DIG. 6, 30/51, 52

[56] References Cited

U.S. PATENT DOCUMENTS

| | | | |
|---|---|---|---|
| 1,596,082 | 8/1926 | Curtis | 30/87 |
| 3,317,995 | 5/1967 | Bord | 30/87 |
| 3,593,416 | 7/1971 | Edson | 30/50 |
| 4,475,286 | 10/1984 | Saito | 30/87 |
| 4,599,793 | 7/1986 | Iten | 30/47 |
| 4,785,534 | 11/1988 | Lazarchik | 30/50 |
| 4,791,724 | 12/1988 | Dumas | 30/89 |
| 4,903,405 | 2/1990 | Halevy | 30/47 |
| 4,955,136 | 9/1990 | Diaz-Rivera | 30/32 |

FOREIGN PATENT DOCUMENTS

| | | | |
|---|---|---|---|
| 103213 | 4/1926 | Austria | 30/89 |
| 69519 | 7/1949 | Denmark | 30/87 |
| 490825 | 2/1954 | Italy | 30/89 |

*Primary Examiner*—Frank T. Yost
*Assistant Examiner*—John M. Husar
*Attorney, Agent, or Firm*—Daniel A. Scola, Jr.; Richard S. Bullitt

[57] ABSTRACT

A pivoting safety razor assembly for holding a blade device has a handle and a flexible member which interconnects the handle with the blade device. The blade device defines a cutting edge and the flexible member bends in response to shaving forces to move the handle in a rotational motion about the cutting edge.

18 Claims, 2 Drawing Sheets

PIVOTING SAFETY RAZOR ASSEMBLY

FIELD OF THE INVENTION

The present invention pertains to safety razors. More particularly, the present invention pertains to shaving apparatus which incorporate pivotable blade assemblies. The present invention is particularly, but not exclusively, useful for shaving body hair.

BACKGROUND OF THE INVENTION

It has long been recognized in the shaving art that manually operated safety razors produce closer, more uniform shaves and cause less nicking when the blade cutting surface conforms to the complexity of a body surface profile. Many past attempts have been made to design a razor blade assembly which permits razor blade operations that produce more optimum shaves. Some of these attempts have disclosed single blade assemblies; some double blade assemblies. For example, U.S. Pat. No. 4,709,477, issued to Ferraro, discloses a double blade assembly featuring pivotally mounted first and second blades which individually pivot around the point at which the blade is mounted on the razor blade assembly. Similarly, U.S. Pat. No. 4,324,041, issued to Trotta, discloses a double blade assembly that features first and second blades which individually pivot about their respective rear edges. As another example, U.S. Pat. No. 3,593,416, issued to Edson, discloses a double blade razor assembly which has a blade carrier that pivots to follow the contour of the surface being shaved. While these and other similar inventions have produced relatively improved shave characteristics, unevenness of shave and nicking can persist. This is because the particular configurations of Ferraro and Trotta, as well as other previous pivoting razor blades, are designed such that the axis of rotation for the entire assembly is displaced from the blade tips, or cutting edge, resulting in significant non-rotational (i.e., translational) relative motion between the blade cutting edge and blade assembly. As is well known, this translational motion produces low frequency blade "chatter," which can result in nicking, discomfort and a relatively uneven shave. Stated differently, for configurations such as disclosed by Ferraro, Trotta, and Edson, the razor blade and the blade holding assembly can rotate independently of each other. It is this independent movement that gives rise to the unwanted "chatter."

In light of the foregoing, the present invention recognizes the need to significantly reduce blade chatter. Therefore, the present invention provides a pivoting safety razor assembly which produces a smoother, closer, more comfortable shave by shifting the axis of rotation of the entire assembly to the blade cutting edge. Further, the present invention provides a pivoting safety razor assembly which minimizes any translational relative motion between the blade cutting edge and the blade assembly. Still further, the present invention provides a pivoting safety razor assembly that achieves the foregoing results by limiting relative motion of the assembly to rotation about the blade cutting edge, thereby providing a highly responsive shaving system. Additionally, the present invention provides a pivoting safety razor assembly which is easy to use, relatively inexpensive to manufacture and comparatively cost effective.

SUMMARY OF THE INVENTION

A preferred embodiment of the novel pivotable safety razor assembly includes a blade device, a handle, and two corrugated flexures connecting the handle to the blade device. As envisioned by the present invention, the blade device comprises a cartridge for fixedly holding at least one razor blade, the cartridge being mounted on the assembly in a fixed relationship with the flexures. The flexures of the present invention are angled relative to each other, such that their respective planes intersect in a line at the cutting edge of the blades. This is done in order to provide for substantially pure rotational movement of the handle about the cutting edge. By establishing a single axis of rotation for the entire assembly, the flexure design of the present invention minimizes translational movement of the handle relative to the cutting edge of the blade on the surface to be shaved. On the other hand, the rotational motion of the handle about the cutting edge also needs to be somewhat limited. To do this, one end of a rigid guide pin is fixedly attached to the blade device, and its other end is slidably engaged with the handle to mechanically limit rotational movement between the handle and the blade device. Rotational movement between the handle and the blade can also be accomplished by eliminating the guide pin and, instead, incorporating a rigid wedge-shaped abutment which extends from the handle between the flexures. As contemplated by the present invention, for a twin blade assembly, an effective cutting edge is established substantially midway between the twin blades. This effective cutting edge functions in all important respects as does the actual cutting edge of a single blade.

The novel features of this invention, as well as the invention itself, both as to its structure and its operation, will be best understood from the accompanying drawings, taken in conjunction with the accompanying description, in which similar reference characters refer to similar parts, and in which:

DETAILED DESCRIPTION OF THE PREFERRED EMBODIMENT

Figure 1:
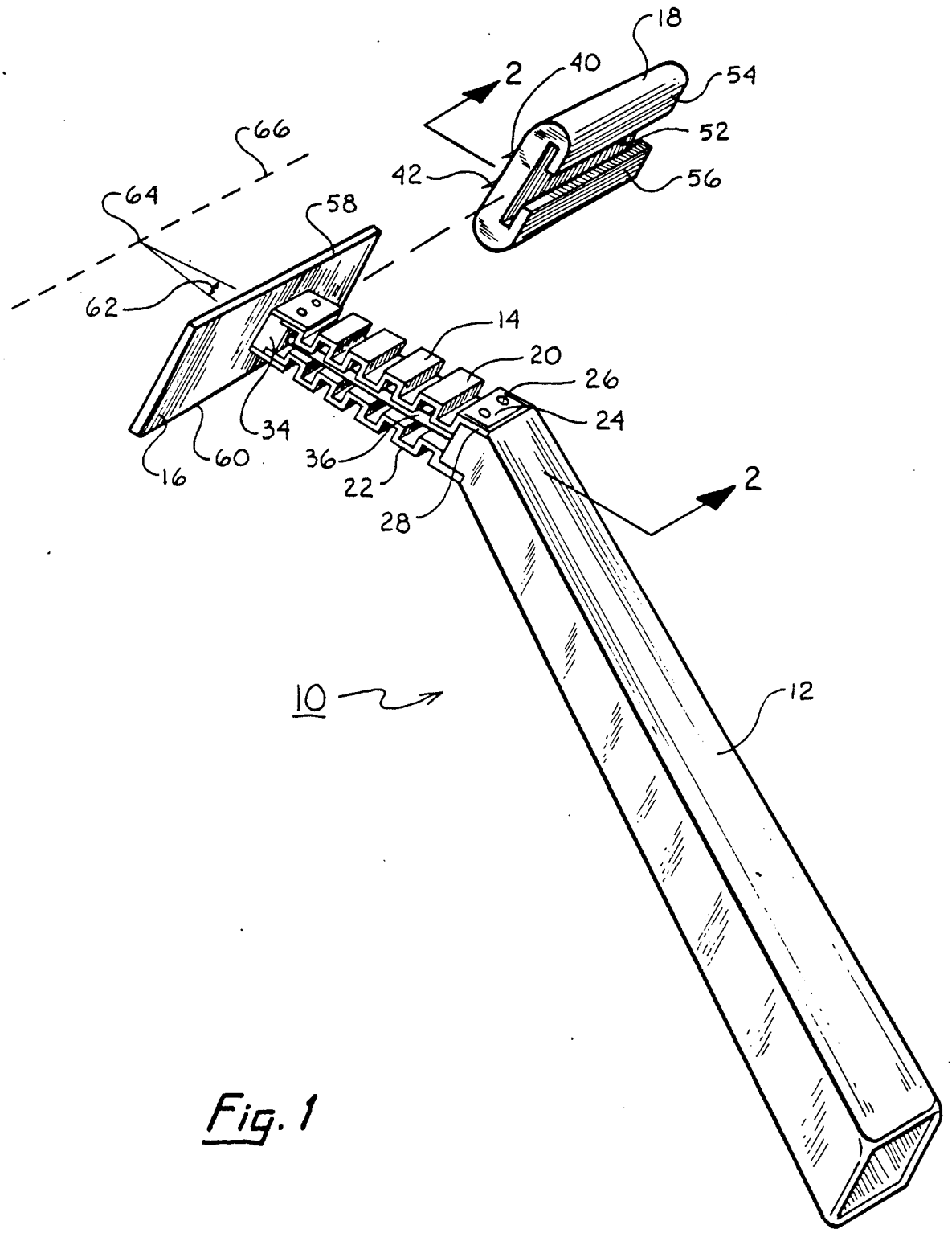
FIG. 1 is an exploded perspective view of the pivot razor assembly showing the blade device separated from the handle.

FIG. 1 shows a perspective view of the pivot razor assembly according to the present invention which is generally designated 10. As shown, the assembly 10 comprises a handle 12, a flexible member 14 and a mounting flange 16 to which a blade device 18 can be engaged. The handle 12 is an essentially rigid component of the assembly 10 and can be made of any appropriate material such as metal or plastic.

Figure 2:
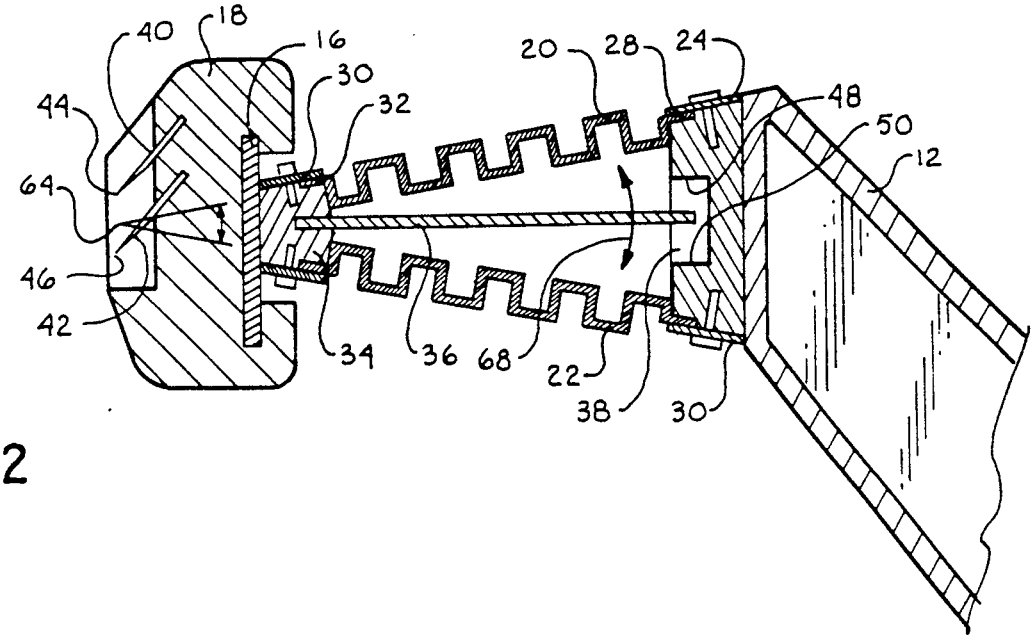
FIG. 2 is a cross-sectional view of a portion of the pivot razor assembly as seen along the line 2—2 in FIG. 1.
Figure 3:
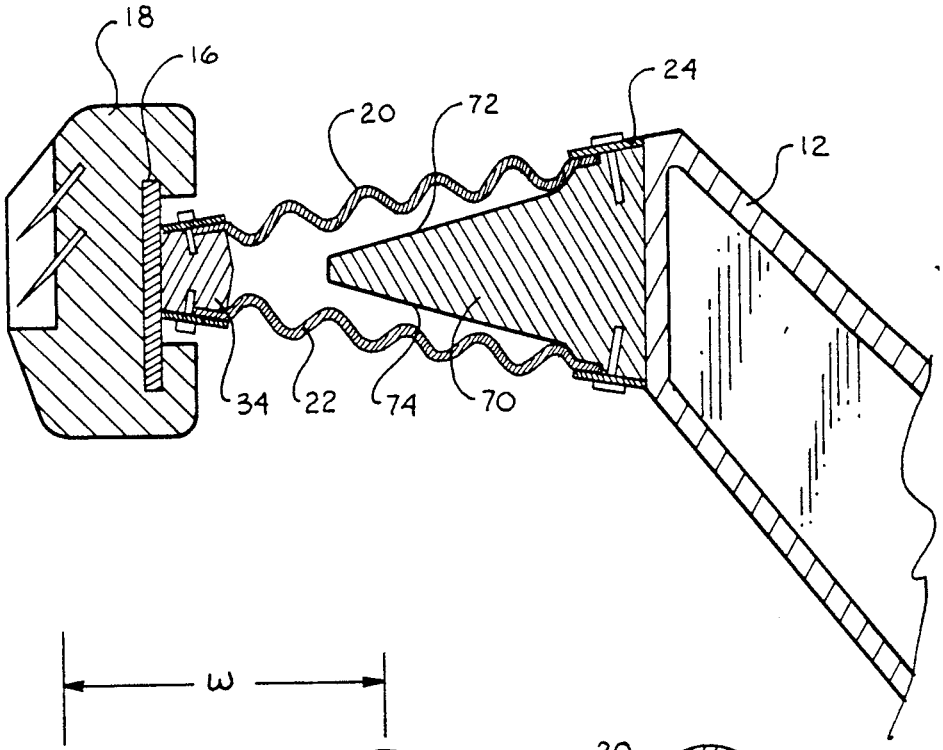
FIG. 3 is a cross-sectional view of a portion of an alternate embodiment of the pivot razor assembly as would be seen along the line 2—2 in FIG. 1.

As shown in both FIG. 1 and FIG. 2, flexible member 14 comprises a pair of flexures 20 and 22 which define planes that are angled with respect to each other. Flexure 20 is preferably corrugated and is bendable about an axis that is substantially parallel to the directional orientation of the individual corrugations. Flexure 20, however, is sufficiently stiff to substantially minimize or effectively prevent bending or flexing of the flexure 20 about axes which are substantially perpendicular to the directional orientation of the corrugations. It is to be appreciated that the corrugations of flexure 20 can be of any suitable geometry. For the embodiment shown in FIG. 1 and FIG. 2, these corrugations are generally rectangular. On the other hand, for the alternate embodiment shown in FIG. 3, the corrugations are rounded. In all important respects, flexure 22 is similar to flexure 20 and, preferably, both flexures 20 and 22 are made of a plastic material such as an acetal.

Flexures 20 and 22 interconnect handle 12 with mounting flange 16 and are respectively connected to these components in any suitable manner well known in the pertinent art. For example, as perhaps best seen by cross referencing FIGS. 1 and 2, a clamp 24 is fastened onto handle 12 by a screw 26, with end 28 of flexure 20 fixedly held between the clamp 24 and the handle 12. In a similar manner, clamp 30 fixedly holds end 32 of flexure 20 on the wedge-shaped extensions 34 of mounting flange 16. Flexure 22 of flexible member 14, like flexure 20, is attached to both handle 12 and extension 34. When so attached, flexure 22 is oriented to establish an angled relationship with flexure 20.

Referring to FIG. 1, the angle 62 between flexures 20 and 22 may theoretically be anywhere in the range of 0°–180°. The present invention, however, envisions an angle 62 in the 20°–40° range. As best seen in FIG. 2, vertex 64 of angle 62 coincides with an effective cutting edge 66, which is substantially midway between actual cutting edges 44 and 46 of blades 40 and 42, respectively. It is to be understood that blades 40 and 42 may be replaced by a single blade without materially affecting the operation of the flexible razor design. In such a case, the effective cutting edge 66 will coincide with the actual cutting edge of the single blade.

The significance of placing vertex 64 on effective cutting edge 66 is important. When blade assembly 10 is so designed, the resulting pivot point of the entire assembly 10 is at the effective cutting edge 66 of the blade 40, or blades 40 and 42. Thus, substantially all of the relative motion between effective cutting edge 66 and blade assembly 10 includes rotational motion and none of the relative motion is purely translational.

As shown in FIGS. 1 and 2, a rigid guide pin 36 extends between flexures 20 and 22, and is fixedly attached to wedge extension 34 by any means well known in the pertinent art. Guide pin 36 may be constructed of any suitable material which has the characteristics of rigidity coupled with sufficient strength in the shear and axial directions to withstand forces produced when guide pin 36 operates to limit flexion of flexible member 14.

Referring to FIG. 2, guide pin 36 extends into guide slot 38 of handle 12. Guide slot 38 must be of sufficient depth to contain guide pin 36 while permitting slidable movement of guide pin 36 in the directions indicated by arrow 68 in FIG. 2.

As will be appreciated by the skilled artisan, the dimension of guide slot 38 establishes the limits of flexion of flexures 20 and 22. As seen in FIG. 2, the movement of flexures 20 and 22 is limited in one direction of flexion when guide pin 36 abuts upper guide slot limit 48, and in the other direction of flexion when pin 36 abuts lower guide slot limit 50. Although a range of flexion angles defined by the vertical dimension of guide slot 38 may be suitable to achieve the desired result, the preferred embodiment envisions an optimum flexion range of about plus or minus ten degrees (10°) in either direction.

In an alternate embodiment for pivot razor assembly 10, the guide pin 36 and guide slot 38 are eliminated. Instead, a fixed wedge-shaped abutment 70 is provided which extends from handle 12 between the flexures 20, 22 as substantially shown in FIG. 3. Specifically, surface 72 of abutment 70 contacts flexure 20 to limit rotation of handle 12 in one direction about the effective cutting edge 66 while surface 74 of abutment 70 contacts flexure 22 to limit counterrotation of handle 12 in the other direction about the effective cutting edge 66.

Figure 4:
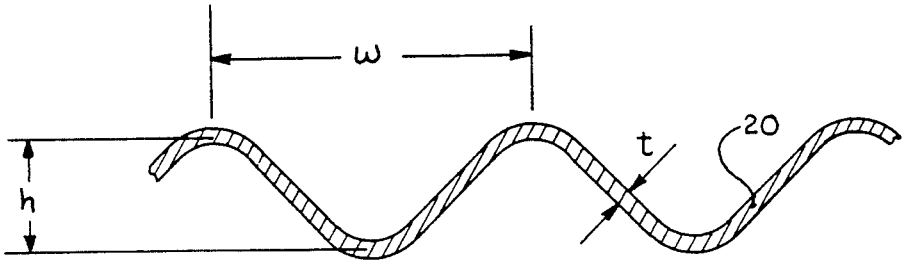
FIG. 4 is a representative side cross-sectional view of a flexure of the pivot razor assembly.

As will be appreciated by the skilled artisan, several variables are involved in determining the actual stiffness of the flexures 20, 22. In FIG. 4, these variables are shown in relation to a rounded corrugated flexure (e.g. flexure 20). More specifically, the variables of interest are thickness of the flexure (t), width of a corrugation (w), and height of a corrugation (h). Of course, the material qualities of flexure 20 are also important, but once a given material is selected, it is the variables t, w, and h which determine the response of flexure 20. By definition, the aspect ratio of flexure 20 is h/w. With this in mind, it happens that for high aspect ratios, i.e. h/w equal to or greater than one (1), the pivot razor assembly 10 is very compliant. This compliance, however, is achieved by compromising good shaving qualities. On the other hand, it has been found that with very low aspect ratios, i.e. h/w near zero (0), t must be reduced to achieve sufficient bending of the flexure 20. Further, with low aspect ratios, there is little, if any, axial compressive capability for the flexure 20. Some balance is required. Thus, it has been determined that the aspect ratio h/w for flexures 20 and 22 is preferably in the range between one fourth and three fourths (i.e. $0.75 \geqq h/w \geqq 0.25$).

It is to be appreciated for the present invention that rectangular corrugations and rounded corrugations for flexures 20 and 22 are effectively interchangeable. Likewise, either guide pin 36 or abutment 70 can be used with either type corrugation to limit rotation of handle 12 about the cutting edge of assembly 10 without departing from the intent of the present invention.

Referring back to FIG. 1, blade device 18 may be fixedly mounted to flexible member 14 in any manner well known in the art. For example, in the preferred embodiment, flange 16 interconnects flexible member 14 and blade device 18. For accomplishing this connection, blade device 18 is formed with a groove 52 that is defined by lips 54 and 56. Flange 16 is slidably attached to blade device 18 by fitting flange 16 snuggly inside groove 52. Lips 54 and 56 are constructed with a tolerance which facilitates the sliding of flange 16 into groove 52, yet which is tight enough to hold blade device 18 onto flange 16 during the assembly operation by effecting an interference fit between edges 58 and 60 and the inner surfaces of lips 54 and 56, respectively. As stated above, blade device 18 may contain one (1) or more blades and may be constructed of any known material having sufficient strength to contain blades 40 and 42. The preferred embodiment envisions a blade device 18 constructed of polystyrene.

OPERATION

In its operation, razor assembly 10 is manually operated by grasping handle 12 and effecting skin contact with blades 40 and 42. The assembly 10 is then moved in short strokes across the surface to be shaved. As such strokes are performed, friction between the shaved surface and blades 40 and 42 produces a moment on assembly 10. The resulting torque flexes flexures 20 and 22, permitting blades 40 and 42 to rotate to conform to the shave surface in proportion to the moment exerted by the shaver. As the shaver applies this moment, flexures 20 and 22 flex to a point where resulting tensile and compressive forces on flexures 20 and 22 equal and cancel the friction-induced torque produced by the moment. Flexures 20 and 22 remain flexed in steady state until the shave stroke (and hence friction-induced torque) is altered. Note that if the friction-induced torque produced by the moment is great enough, guide pin 36 will be forced into upper limit 48 or lower limit 50, as appropriate, of guide slot 38. Alternatively, for the embodiment incorporating an abutment 70, the travel of flexures 20 and 22 is limited by contact with the abutment 70. In either case, flexion of flexures 20 and 22 is thereby limited, as excess friction-induced torque not counteracted by the tensile and compressive forces associated with flexure 20 and 22 is mechanically cancelled. When the moment which produced the friction-induced torque is removed, flexures 20 and 22 return to their neutral angle position.

While the particular pivoting safety razor assembly as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. A pivot razor assembly which comprises:

an elongated flexible means for holding at least one blade having a first end and a second end;

at least one blade having an effective cutting edge mounted on said holding means with said cutting edge substantially at said first end; and a handle fixedly attached to said second end of said holding means, wherein said holding means comprises means for bending having at least two segments which define an angle, wherein the vertex of said angle is substantially at said effective cutting edge.

2. A pivot razor assembly as recited in claim 1, further comprising a cartridge for fixedly holding said blade, said cartridge being mounted on said holding means.

3. A pivot razor assembly as recited in claim 1, wherein said holding means comprises a first flexure having a first and a second end, and a second flexure having a first and second end, said first flexure being angled relative to said second flexure and said first and second ends of said flexures being respectively located at said first and second ends of said flexible means.

4. A pivot razor assembly as recited in claim 3, wherein said first and said second flexures are corrugated.

5. A pivot razor assembly as recited in claim 3, wherein said first flexure is angled relative to said second flexure by an angle in the range of twenty to forty degrees (20°-40°).

6. A pivot razor assembly as recited in claim 1, comprising at least two blades.

7. A pivot razor assembly as recited in claim 1, further comprising a rigid guide pin having a first end fixedly attached to said blade device and a second end slidingly engageable with said handle to limit relative movement between said blade device and said handle.

8. A pivot razor assembly as recited in claim 7, wherein said guide pin is positioned between said first and second flexures.

9. A pivot razor assembly as recited in claim 3, further comprising a fixed abutment extending from said handle between said first flexure and said second flexure for limiting movement of said flexures.

10. An assembly for holding at least one blade having an effective cutting edge which comprises:

a handle;

an elongated, resilient, corrugated support having a first end supporting said blade, and having a second end fixedly attached to said handle.

11. An assembly for holding a blade having an effective cutting edge as recited in claim 10, wherein said support comprises a first flexure having a first end and a second end, and a second flexure having a first and second end, said first flexure being angled relative to said second flexure and said first and second ends of said flexures being respectively located at said first and second ends of said support.

12. An assembly for holding a blade having an effective cutting edge as recited in claim 11, wherein said first and said second flexures are corrugated.

13. An assembly for holding a blade having an effective cutting edge as recited in claim 11, wherein said first flexure is angled relative to said second flexure by an angle in the range of twenty to forty degrees (20°-40°).

14. An assembly for holding a blade having an effective cutting edge as recited in claim 10, further comprising a cartridge for fixedly holding said blade, said cartridge being fixedly mounted on said first end of said support.

15. An assembly for holding a blade having an effective cutting edge as recited in claim 10, further comprising a rigid guide pin having a first end fixedly attached to said blade device and a second end slidingly engageable with said handle to limit relative movement between said blade device and said handle, and wherein said guide pin is positioned between said first and second flexures.

16. An assembly for holding a blade having an effective cutting edge as recited in claim 10, further comprising a fixed abutment extending from said handle between said first flexure and said second flexure for limiting movement of said flexures.

17. A razor comprising:

(a) a handle:

(b) at least one blade defining an effective cutting edge; and (c) means for reducing chatter joined to said handle and said blade, wherein said chatter reducing means comprises at least two flexible members which are disposed at an angle defining a pivot point for said razor substantially at said effective cutting edge.

18. The razor of claim 17, further comprising restraining means for preventing excessive flexing of said flexible means for reducing chatter.

* * * * *